US008994281B2

(12) United States Patent
Hwang et al.

(10) Patent No.: US 8,994,281 B2
(45) Date of Patent: Mar. 31, 2015

(54) LIGHT EMITTING DIODE DRIVING APPARATUS

(75) Inventors: Jong Tae Hwang, Gyunggi-do (KR); Deuk Hee Park, Gyunggi-do (KR); Sang Hyun Cha, Gyunggi-do (KR); Chang Seok Lee, Gyunggi-do (KR); Yun Joong Lee, Gyunggi-do (KR)

(73) Assignee: Samsung Electro-Mechanics Co., Ltd., Suwon-Si (KR)

( * ) Notice: Subject to any disclaimer, the term of this patent is extended or adjusted under 35 U.S.C. 154(b) by 217 days.

(21) Appl. No.: 13/620,290

(22) Filed: Sep. 14, 2012

(65) Prior Publication Data

US 2014/0035476 A1 Feb. 6, 2014

(30) Foreign Application Priority Data

Jul. 31, 2012 (KR) ..... 10-2012-0084098

(51) Int. Cl.
*H05B 37/00* (2006.01)
*H05B 37/02* (2006.01)
*H05B 33/08* (2006.01)

(52) U.S. Cl.
CPC ..... *H05B 33/0815* (2013.01)
USPC ..... 315/201; 315/297

(58) Field of Classification Search
USPC ..... 315/201, 250, 210, 297, 307
See application file for complete search history.

(56) References Cited

U.S. PATENT DOCUMENTS 6,515,876 B2 * 2/2003 Koike et al. ..... 363/21.16
2011/0037414 A1 2/2011 Wang et al.
2013/0257305 A1 * 10/2013 Lee et al. ..... 315/210

FOREIGN PATENT DOCUMENTS

KR 2011-0098811 A 9/2011
WO WO-2010/067274 A1 6/2010

* cited by examiner

*Primary Examiner* — Daniel D Chang
(74) *Attorney, Agent, or Firm* — McDermott Will & Emery LLP

(57) ABSTRACT

There is provided a light emitting diode driving apparatus capable of supplying a constant average current to a light emitting diode by generating a reference voltage used for driving the light emitting diode according to input power and a switching signal switching a path of a current supplied to the light emitting diode. The light emitting diode driving apparatus includes: a reference voltage generating unit generating a reference voltage set based on input power and a switching signal for supplying driving power to a light emitting diode; and a driving unit supplying the driving power to the light emitting diode according to the reference voltage.

12 Claims, 4 Drawing Sheets

LIGHT EMITTING DIODE DRIVING APPARATUS

CROSS-REFERENCE TO RELATED APPLICATIONS

This application claims the priority of Korean Patent Application No. 10-2012-0084098 filed on Jul. 31, 2012, in the Korean Intellectual Property Office, the disclosure of which is incorporated herein by reference.

BACKGROUND OF THE INVENTION

1. Field of the Invention

The present invention relates to a light emitting diode driving apparatus capable of supplying a constant average current to a light emitting diode.

2. Description of the Related Art

Recently, interest in and demand for light emitting diodes (LED) have increased.

A device using a light emitting diode may be manufactured to have a compact form, such that it may even be used in a place in which it is difficult to install an existing electronic product. In the case in which the light emitting diode is used as a lighting device, various colors and degrees of luminance may easily be implemented therein, such that it may be used in a lighting system device appropriate for an activity such as watching movies, reading books, conferencing, and the like.

In addition, the light emitting diode consumes approximately ⅛ of the power consumed by an incandescent lamp, has a lifespan of fifty thousand to one hundred thousand hours corresponding to 5 to 10 times that of an incandescent lamp, is environmentally-friendly, since it is a mercury free light source, and may be variously implemented.

Due to these characteristics, light emitting diode lighting projects have been promoted as nationally-funded projects in many nations such as Korea, the United State, Japan, Australia, and others.

Further, recently, in accordance with the development of flat panel display technology, a flat panel display has been used in an automobile instrument panel as well as in a smart phone, a game machine, and a digital camera. In future, a range of flat panel display applications will be increased in devices related to daily life, such as a micro-thin television, a transparent navigation device, or the like. Further, in the current display industry, a new flat panel display (FPD) market reflecting multimedia requirements such as a high resolution, large screens, and the like, has been prominent. Particularly, in the case of a large display market, a liquid crystal display (LCD) TV has been rapidly grown, such that it is expected that the LCD TV will perform a leading role in view of price and marketability.

As a flat panel display, a thin film transistor liquid crystal display (TFT-LCD) is mainly used. This TFT-LCD includes a backlight unit emitting light and mainly uses a cold cathode fluorescent lamp (CCFL) as aback light source. However, in recent times, an LED has gradually come into use therein, due to various advantages in terms of power consumption, lifespan, environmental friendliness, and the like. Therefore, a relatively inexpensive electronic power system for a backlight unit power module using the LED, and an appropriate control element therefor, have been urgently demanded.

As described above, the light emitting diode of which the use has increased requires a driving apparatus for the driving thereof. As described in the following Related Art Document, in the case of using direct current (DC) power, since a circuit supplying the DC power may be relatively complicated, a technology of driving a light emitting diode using rectified power has been developed. However, in this technology, regulation characteristics of current transferred to the light emitting diode may be deteriorated.

RELATED ART DOCUMENT (Patent Document 1) Korean Patent Laid-Open Publication No. 2011-0098811

SUMMARY OF THE INVENTION

An aspect of the present invention provides a light emitting diode driving apparatus capable of supplying a constant average current to a light emitting diode by generating a reference voltage used for driving the light emitting diode according to input power and a switching signal switching a path of a current supplied to the light emitting diode.

According to an aspect of the present invention, there is provided a light emitting diode driving apparatus including: a reference voltage generating unit generating a reference voltage set based on input power and a switching signal for supplying driving power to a light emitting diode; and a driving unit supplying the driving power to the light emitting diode according to the reference voltage.

The reference voltage generating unit may generate the reference voltage according to a voltage level of the input power and duty information of the switching signal.

The reference voltage generating unit may generate the reference voltage according to the voltage level of the input power, the duty information of the switching signal, and a demagnetizing signal of power obtained by detecting the driving power supplied to the light emitting diode.

The reference voltage generating unit may include: an auto gain controller constantly controlling the voltage level of the input power according to a preset gain; a signal information extractor extracting time information of on/off-duties of the switching signal and time information of an on-duty of the demagnetizing signal from the switching signal and the demagnetizing signal; a gain provider amplifying a time information value from the signal information extractor according to the preset gain; and a divider dividing the voltage level from the auto gain controller by the time information value from the gain provider to provide the reference voltage.

The driving unit may include: a comparator comparing the reference voltage with a voltage of a primary side power inducing the driving power; an on-time generator determining a switching on-time from the voltage obtained by detecting the driving power on a primary side; and an RS latch providing the switching signal controlling the switching of the primary side power according to a result of a comparison of the comparator and the switching on-time determined by the on-time generator.

The light emitting diode driving apparatus may further include a detecting unit providing the demagnetizing signal from a voltage obtained by detecting the driving power on a primary side.

According to another aspect of the present invention, there is provided a light emitting diode driving apparatus including: a rectifying unit rectifying alternating current (AC) power; a reference voltage generating unit generating a reference voltage set based on input power from the rectifying unit and a switching signal for supplying driving power to a light emitting diode; a driving unit controlling the switching of the input power according to the reference voltage to supply the driving power to the light emitting diode; and a transformer having a primary winding receiving the input power, a secondary winding electromagnetically coupled to the primary winding according to a preset turns ratio, receiving induced power, and providing the driving power to the light emitting diode, and an auxiliary winding formed together with the primary winding on a primary side and receiving the driving power induced from the secondary winding.

The reference voltage generating unit may generate the reference voltage according to a voltage level of the input power and duty information of the switching signal.

The reference voltage generating unit may generate the reference voltage according to the voltage level of the input power, the duty information of the switching signal, and a demagnetizing signal of power detected by the auxiliary winding.

The reference voltage generating unit may include an auto gain controller constantly controlling the voltage level of the input power according to a preset gain; a signal information extractor extracting time information of on/off-duties of the switching signal and time information of an on-duty of the demagnetizing signal from the switching signal and the demagnetizing signal; a gain provider amplifying a time information value from the signal information extractor according to the preset gain; and a divider dividing the voltage level from the auto gain controller by the time information value from the gain provider to provide the reference voltage.

The driving unit may include a comparator comparing the reference voltage with a voltage obtained by detecting current flowing in a power switch connected to the primary winding of the transformer to switch the input power; an on-time generator determining a switching on-time from power detected by the auxiliary winding of the transformer; and an RS latch providing the switching signal controlling the switching of the power switch according to a result of a comparison of the comparator and the switching on-time determined by the on-time generator.

The light emitting diode driving apparatus may further include a detecting unit providing the demagnetizing signal from the power detected by the auxiliary winding.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE EMBODIMENTS

Figure 1:
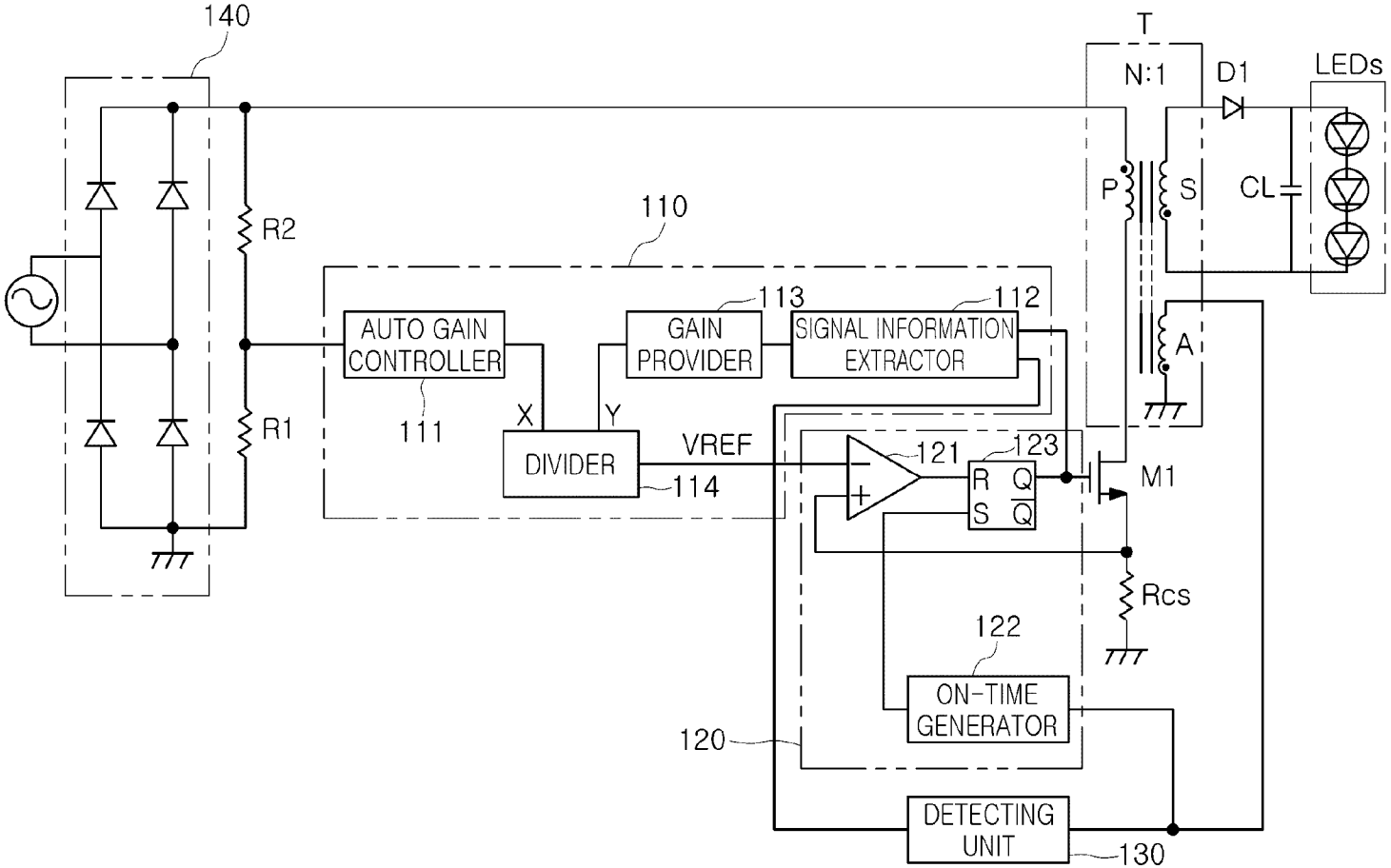
FIG. 1 is a schematic circuit diagram of a light emitting diode (LED) driving apparatus according to an embodiment of the present invention.

Hereinafter, embodiments of the present invention will be described in detail with reference to the accompanying drawings so that they can be easily practiced by those skilled in the art to which the present invention pertains.

However, in describing embodiments of the present invention, detailed descriptions of well-known functions or constructions will be omitted so as not to obscure the description of the present invention with unnecessary detail.

In addition, like or similar reference numerals denote parts performing similar functions and actions throughout the drawings.

It will be understood that when an element is referred to as being "connected to" another element, it can be directly connected to the other element or may be indirectly connected to the other element with element(s) interposed therebetween.

In addition, unless explicitly described to the contrary, the word "comprise" and variations such as "comprises" or "comprising," will be understood to imply the inclusion of stated elements but not the exclusion of any other elements.

Embodiments of the present invention will now be described in detail with reference to the accompanying drawings.

FIG. 1 is a schematic circuit diagram of a light emitting diode (LED) driving apparatus according to an embodiment of the present invention.

Referring to FIG. 1, a light emitting diode driving apparatus 100 according to the embodiment of the present invention may include a reference voltage generating unit 110, a driving unit 120, a detecting unit 130, a rectifying unit 140, and a transformer T.

The reference voltage generating unit 110 may include an auto gain controller (AGC) 111, a signal information extractor 112, a gain provider 113, and a divider 114.

Figure 2:
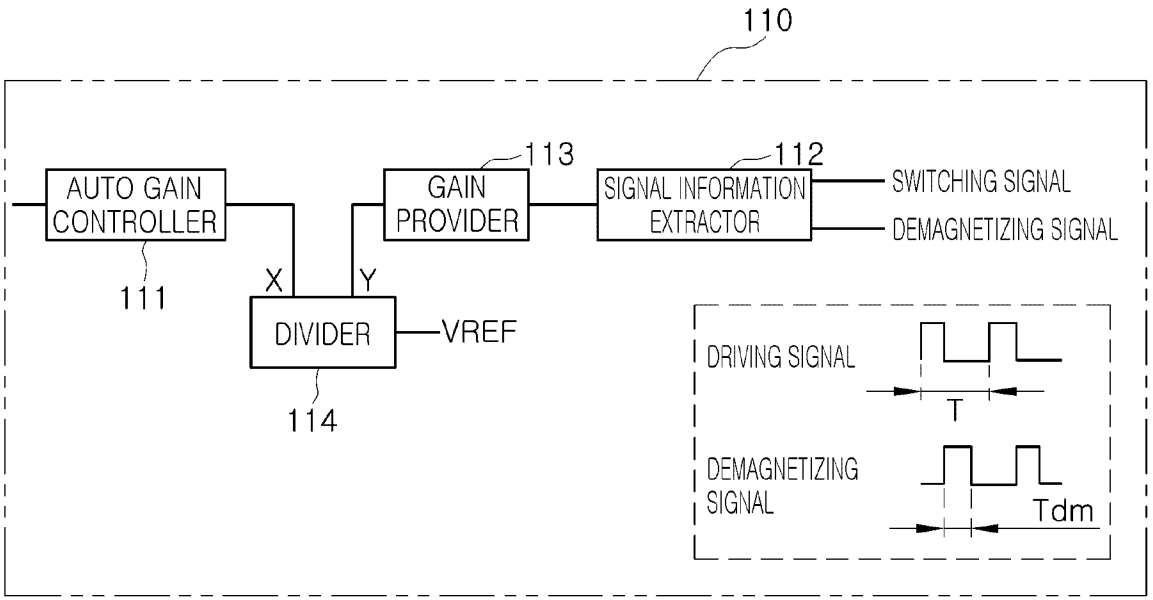
FIG. 2 is a schematic circuit diagram of a reference voltage generating unit used in the light emitting diode driving apparatus according to the embodiment of the present invention.

FIG. 2 is a schematic circuit diagram of a reference voltage generating unit used in the light emitting diode (LED) driving apparatus according to the embodiment of the present invention;

Referring to FIGS. 1 and 2, the auto gain controller 111 may automatically control a gain to constantly maintain a voltage level of input power from the rectifying unit 140 rectifying alternating current (AC) power. More particularly, the auto gain controller 111 may control a peak value of the rectified power having a positive voltage level by rectifying the AC power having a sinusoidal waveform so as to have a constant voltage level according to the automatically controlled gain.

The signal information extractor 112 may extract time information T of on/off-duties of a switching signal controlling the on/off switching of a power switch M1 and time information Tdm of an on-duty of a demagnetizing signal from the detecting unit 130 detecting the demagnetizing signal from power detected by an auxiliary winding A of the transformer T based on the switching signal and the demagnetizing signal. The time information of the signal information extractor 112 may be transferred to the gain provider 113 according to Equation: Tdm/T.

The gain provider 113 may multiply the time information from the signal information extractor 112 by a preset gain and transfer the result of multiplication to the divider 114.

The divider 114 may divide the voltage level from the auto gain controller 111 by the time information from the gain provider 113 to provide a reference voltage VREF.

Again referring to FIG. 1, the driving unit 120 may provide the switching signal controlling the switching of the power switch M1 based on the reference voltage VREF from the reference voltage generating unit 110, voltage obtained by detecting current flowing in the power switch M1, and the detected power from the auxiliary winding A receiving power induced from a secondary winding S of the transformer T.

The driving unit 120 may include a comparator 121, an on-time generator 122, and an SR latch 123.

The comparator 121 may compare the reference voltage VREF from the reference voltage generating unit 110 and the current flowing in the power switch M1 with a voltage detected through a resistor Rcs and transfer the result of a comparison to the SR latch 123.

The on-time generator 122 may determine the on-time of the power switch M1 from the detected power from the auxiliary winding A receiving the power induced from the secondary winding S of the transformer T and transfer the determined on-time to the SR latch 123.

The SR latch 123 may include a reset terminal R to which the result of the comparison from the comparator 121 is input and a set terminal S to which the determined on-time signal from the on-time generator 122 is transferred, logically operate signals input to the reset terminal R and the set terminal S, and provide the switching signal that is the result of the logical operation to the power switch M1 through an output terminal Q.

The detecting unit 130 may provide the demagnetizing signal based on the detected power induced in the auxiliary winding A of the transformer T.

The transformer T may include a primary winding P, the secondary winding S, and the auxiliary winding A.

The primary winding P and the secondary winding S may be formed to have a preset turns ratio (N:1) to thereby be electromagnetically coupled to each other, the primary winding P may receive the rectified power from the rectifying unit 140, the secondary winding S may receive the driving power induced according to the on/off switching of the power switch M1, and a voltage level of the induced driving power may be determined by the turns ratio. The driving power that is induced in the secondary winding S may be stabilized by a diode D1 and a capacitor C1 and be supplied to light emitting diodes (LEDs).

The auxiliary winding A may be formed together with the primary winding P on a primary side and receive driving power introduced to the secondary winding S formed on a secondary side to detect the voltage level of the driving power.

An operation of the reference voltage generating unit 110 as described above may be represented by the following equation:

$$VREF = \frac{K1}{K2} \cdot \frac{\sin(\phi)}{1 - D(t)}$$

where VREF may be reference voltage, K1 may be a gain of an auto gain controller, K2 may be a gain of a gain provider, sin(ϕ) may be a waveform of rectified AC power, and 1−D(t) may be Tdm/T.

Figure 3:
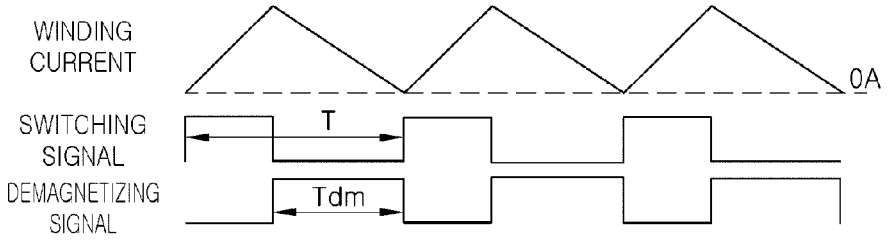
FIGS. 3 and 4 are graphs showing waveforms of main units according to an operating mode of the light emitting diode driving apparatus according to the embodiment of the present invention.
Figure 4:
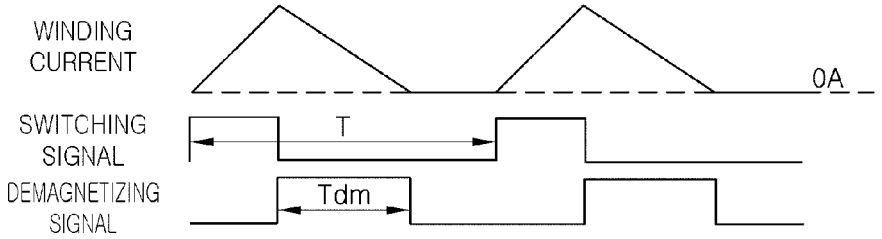

FIGS. 3 and 4 are graphs showing waveforms of main units according to an operating mode of the light emitting diode driving apparatus according to the embodiment of the present invention.

The light emitting diode driving apparatus according to the embodiment of the present invention may operate in a critical conduction mode (CCM) and a discontinuous conduction mode (DCM).

FIG. 3 is a graph showing a waveform of power appearing in the primary winding of the transformer and waveforms of a switching signal and a demagnetizing signal, at the time of operating in the CCM.

Referring to FIG. 3, an on-duty time of the demagnetizing signal may be recognized from the waveform of the switching signal while operating in the CCM mode.

FIG. 4 is a graph showing a waveform of power appearing in the secondary winding of the transformer and waveforms of a switching signal and a demagnetizing signal, at the time of operating in the DCM mode.

Referring to FIG. 4, the on-duty time of the demagnetizing signal may not be recognized from the switching signal until the entire period of the current of the primary winding is completed. Therefore, the signal information extractor 112 may provide Tdm/T information to participate in generation of the reference voltage VREF.

In the case of switching the power switch M1 based on the reference voltage, the peak current of the primary winding may be represented by the following Equation:

$$Ipk = \frac{1}{Rcs} \cdot \frac{K1}{K2} \cdot \frac{\sin(\phi)}{1 - D(t)}$$

where Ipk may be a peak current and Rcs may be a detected resistance value.

Here, in the case of considering the operation in the DCM mode, a current value supplied to the light emitting diode within one switching period may be represented by the following Equation:

$$ILED = \frac{N}{2} \cdot Ipk \cdot (1 - D(t)).$$

Calculating the current value of the light emitting diode using two Equations as described above, the following Equation may be obtained:

$$ILED = \frac{N}{2} \cdot Ipk \cdot (1 - D(t)) = \frac{N}{2} \cdot \frac{K1}{K2} \cdot \frac{\sin(\phi)}{Rcs}$$

Here, calculating an average current value of the light emitting diode, the following Equation may be obtained:

$$ILED,\ avg = \frac{\int_{\phi=0}^{\pi} \left( \frac{N}{2} \cdot \frac{K1}{K2} \cdot \frac{\sin(\phi)}{Rcs} \right) d\phi}{\pi} = \frac{N}{\pi} \cdot \frac{K1}{K2} \cdot \frac{1}{Rcs}$$

That is, it may be appreciated that the average current of the light emitting diode is constantly maintained regardless of the voltage level of the input power and the duty of the switching signal.

Figure 5:
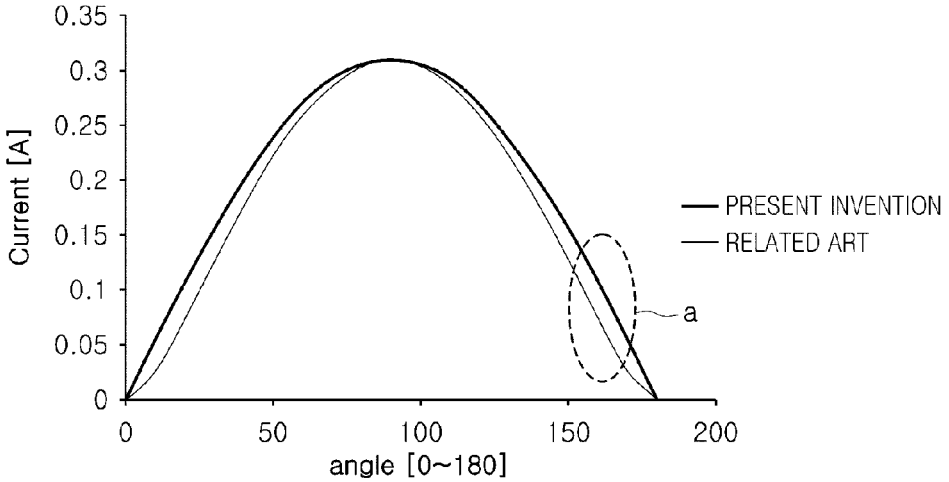
FIGS. 5 through 7 are graphs in which electrical characteristics of the light emitting diode driving apparatus according to the embodiment of the present invention are compared with those of a light emitting diode driving apparatus according to the related art.
Figure 6:
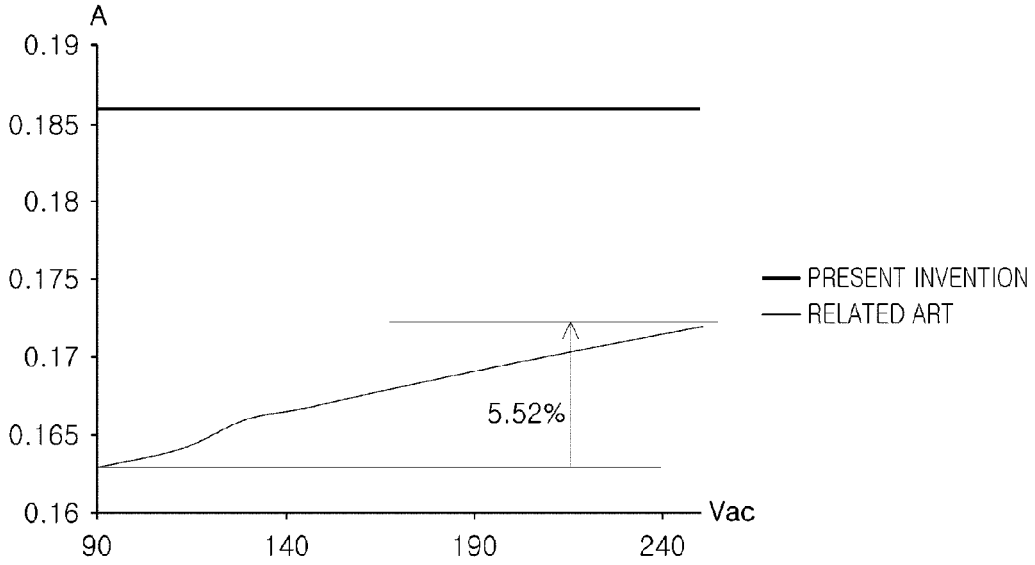
Figure 7:
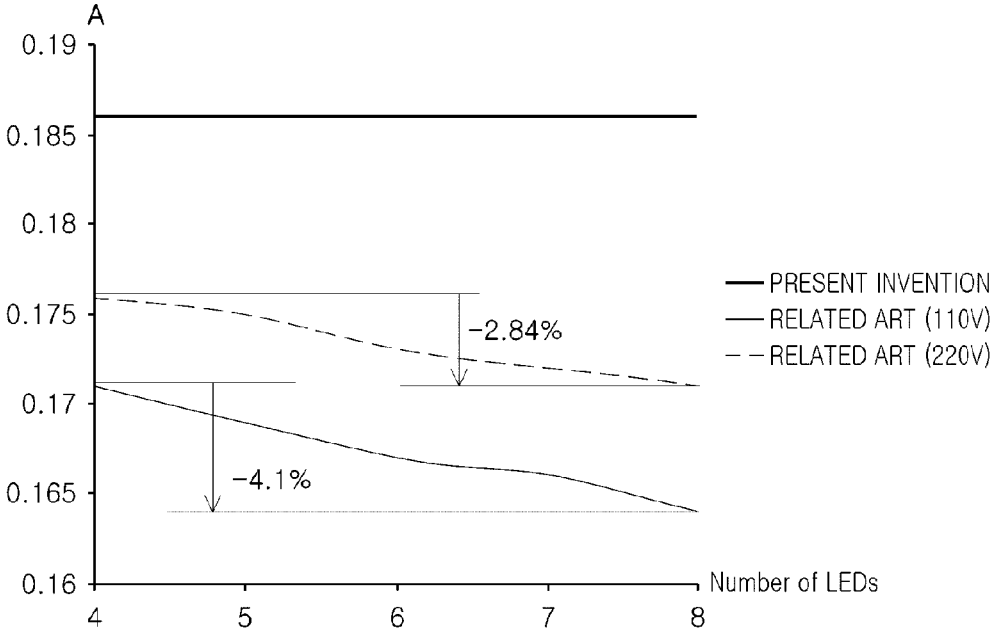

FIGS. 5 through 7 are graphs in which electrical characteristics of the light emitting diode driving apparatus according to the embodiment of the present invention are compared with those of alight emitting diode driving apparatus according to the related art.

It may be appreciated from FIG. 5 that the light emitting diode driving apparatus according to the embodiment of the present invention applies an instantaneous change in the duty of the switching signal at a point at which the duty of the switching signal is not maximum, as compared with the related art in which switching is controlled based on the maximum duty of the switching signal, whereby a difference 'a' is generated.

It may be appreciated from FIG. 6 that even in the case that the voltage level of the input power is varied, the current supplied to the light emitting diode is not varied in the light emitting diode according to the embodiment of the present invention, as compared with the above-mentioned related art.

It may be appreciated from FIG. 7 that in the case in which the number of light emitting diodes is increased from four to eight, the supplied current is not varied in the light emitting diode according to the embodiment of the present invention; however, the supplied current is significantly varied at 110 V, particularly, 220 V in the light emitting diode according to the related art.

As set forth above, according to embodiments of the present invention, the reference voltage used for driving the light emitting diode is generated according to the input power and the switching signal switching the path of the current supplied to the light emitting diode, whereby the constant average current may be supplied to the light emitting diode regardless of the variation of the input power or the variation of the load.

While the present invention has been shown and described in connection with the embodiments, it will be apparent to those skilled in the art that modifications and variations can be made without departing from the spirit and scope of the invention as defined by the appended claims.

What is claimed is:

1. A light emitting diode driving apparatus comprising:

a reference voltage generating unit generating a reference voltage set based on input power and a switching signal for supplying driving power to a light emitting diode; and a driving unit supplying the driving power to the light emitting diode according to the reference voltage.

2. The light emitting diode driving apparatus of claim 1, wherein the reference voltage generating unit generates the reference voltage according to a voltage level of the input power and duty information of the switching signal.

3. The light emitting diode driving apparatus of claim 2, wherein the reference voltage generating unit generates the reference voltage according to the voltage level of the input power, the duty information of the switching signal, and a demagnetizing signal of power obtained by detecting the driving power supplied to the light emitting diode.

4. The light emitting diode driving apparatus of claim 3, wherein the reference voltage generating unit includes:

an auto gain controller constantly controlling the voltage level of the input power according to a preset gain;

a signal information extractor extracting time information of on/off-duties of the switching signal and time information of an on-duty of the demagnetizing signal from the switching signal and the demagnetizing signal;

a gain provider amplifying a time information value from the signal information extractor according to the preset gain; and a divider dividing the voltage level from the auto gain controller by the time information value from the gain provider to provide the reference voltage.

5. The light emitting diode driving apparatus of claim 1, wherein the driving unit includes:

a comparator comparing the reference voltage with a voltage of a primary side power inducing the driving power;

an on-time generator determining a switching on-time from the voltage obtained by detecting the driving power on a primary side; and an RS latch providing the switching signal controlling the switching of the primary side power according to a result of a comparison of the comparator and the switching on-time determined by the on-time generator.

6. The light emitting diode driving apparatus of claim 3, further comprising a detecting unit providing the demagnetizing signal from a voltage obtained by detecting the driving power on a primary side.

7. A light emitting diode driving apparatus comprising:

a rectifying unit rectifying alternating current (AC) power;

a reference voltage generating unit generating a reference voltage set based on input power from the rectifying unit and a switching signal for supplying driving power to a light emitting diode;

a driving unit controlling the switching of the input power according to the reference voltage to supply the driving power to the light emitting diode; and a transformer having a primary winding receiving the input power, a secondary winding electromagnetically coupled to the primary winding according to a preset turns ratio, receiving induced power, and providing the driving power to the light emitting diode, and an auxiliary winding formed together with the primary winding on a primary side and receiving the driving power induced from the secondary winding.

8. The light emitting diode driving apparatus of claim 7, wherein the reference voltage generating unit generates the reference voltage according to a voltage level of the input power and duty information of the switching signal.

9. The light emitting diode driving apparatus of claim 8, wherein the reference voltage generating unit generates the reference voltage according to the voltage level of the input power, the duty information of the switching signal, and a demagnetizing signal of power detected by the auxiliary winding.

10. The light emitting diode driving apparatus of claim 9, wherein the reference voltage generating unit includes:

an auto gain controller constantly controlling the voltage level of the input power according to a preset gain;

a signal information extractor extracting time information of on/off-duties of the switching signal and time information of an on-duty of the demagnetizing signal from the switching signal and the demagnetizing signal;

a gain provider amplifying a time information value from the signal information extractor according to the preset gain; and a divider dividing the voltage level from the auto gain controller by the time information value from the gain provider to provide the reference voltage.

11. The light emitting diode driving apparatus of claim 7, wherein the driving unit includes:

a comparator comparing the reference voltage with a voltage obtained by detecting current flowing in a power switch connected to the primary winding of the transformer to switch the input power;

an on-time generator determining a switching on-time from power detected by the auxiliary winding of the transformer; and an RS latch providing the switching signal controlling the switching of the power switch according to a result of a comparison of the comparator and the switching on-time determined by the on-time generator.

12. The light emitting diode driving apparatus of claim 9, further comprising a detecting unit providing the demagnetizing signal from the power detected by the auxiliary winding.

* * * * *